US006538535B2

(12) United States Patent
Guglielmi et al.

(10) Patent No.: US 6,538,535 B2
(45) Date of Patent: Mar. 25, 2003

(54) DUAL-MODE MICROWAVE FILTER

(75) Inventors: Marco Guglielmi, Wassenaar (NL); Pierre Jarry, Talence (FR); Eric Kerherve, Mérignac (FR)

(73) Assignee: Agence Spatiale Europeenne, Paris (FR)

( * ) Notice: Subject to any disclaimer, the term of this patent is extended or adjusted under 35 U.S.C. 154(b) by 0 days.

(21) Appl. No.: 09/865,672

(22) Filed: May 29, 2001

(65) Prior Publication Data

US 2002/0024410 A1 Feb. 28, 2002

(30) Foreign Application Priority Data

Jun. 5, 2000 (FR) ..... 00 7148

(51) Int. Cl.[7] ..... H01P 1/208; H01P 7/06

(52) U.S. Cl. ..... 333/208; 333/212; 333/227

(58) Field of Search ..... 333/202, 208, 333/212, 228, 230, 227

(56) References Cited

U.S. PATENT DOCUMENTS

| | | | | | |
|---|---|---|---|---|---|
| 2,357,313 | A | * | 9/1944 | Carter | 315/5.16 |
| 2,737,630 | A | * | 3/1956 | Miller | 333/208 |
| 4,060,779 | A | * | 11/1977 | Atia et al. | 333/21 A |
| 4,180,787 | A | * | 12/1979 | Pfitzenmaier | 333/212 |
| 5,589,807 | A | * | 12/1996 | Tang | 333/212 |

FOREIGN PATENT DOCUMENTS

CA 1050127 * 3/1979

OTHER PUBLICATIONS

Liang et al., "Dual Mode Coupling by Square Corner Cut in Resonators and filters", IEEE trans. on Microwave theory & Tech., vol. 40, No. 12, Dec. 1992, pp 2294–2302.*

Orta et al, "Rectangular Waveguide Dual–Mode Filters Without Discontinuities Inside the Resonators", IEEE Microwave and Guided Wave Letters, vol. 5, No. 9, Sep. 1995, pp. 302–304.*

Savi et al., "A New Approach to the Design of Dual–Mode rectangular waveguide filters with Distributed Coupling", IEEE trans. on Microwave theory & Tech., vol. 45, No. 2, Feb. 1997, pp 221–228.*

Chang et al., "Evanescent–Mode Coupling of Dual–Mode Rectangular Waveguide Filters", IEEE trans. on Microwave theory & Tech., vol. 39, No. 8, Aug. 1991, pp 1307–1312.*

E.L. Griffin et al., "A Comparison of Four Overmoded Canonical Narrow Bandpass Filters At 12 GHZ", pp. 47–49 XP002162848, Jun. 27, 1978.

Orta R. et al., "A New Configuration of Dual–Mode Rectangular Waveguide Filters" Proceedings of the European Microwave Conference, GB, Swanley, Nexus Media, vol. conf. 25, pp. 538–542, XP000740189, Sep. 4, 1995.

Lastoria G et al., "Cad of Triple–Mode Cavaities in Rectangular Waveguide" IEEE Microwave and Guided Wave Letters, US, IEEE Inc. New York, vol. 8, No. 10, pp. 339–341, XP000788271, Oct. 1, 1998.

* cited by examiner

*Primary Examiner*—Seungsook Ham
(74) *Attorney, Agent, or Firm*—Sughrue Mion, PLLC

(57) ABSTRACT

The invention provides a dual-mode microwave filter, comprising a rectangular resonator of length l, height b, and width a operating in two distinct modes (m, 0, n) and (p, 0, q) from a single family of modes and presenting the same direction as the E field, and wherein coupling and mode excitation discontinuities are inductive and in the same direction.

12 Claims, 3 Drawing Sheets

$t_1$=1,2282 $a_1$=7,4868 $O_1$=16,600 $l_1$=24,9146
$t_2$=9,1671 $a_2$=7,5380 $O_2$=17,600 $l_2$=42,8847
$t_3$=2,2651 $a_3$=7,2953 $O_3$=18,758 $l_3$=25,0565
a=19,05 $O_4$=16,900 $l_4$=42,6639
b=9,525 a=19,05 $l_1$=27,867 $t_1$=2,4
b=9,525 $l_2$=28,0 $t_2$=10,8
$a_1$=$a_2$=11,0 $t_3$=4,6 $t_4$=4,5

$a = 19{,}05$ $l_1 = 28{,}306$ $t_1 = 3{,}000$
$b = 9{,}525$ $l_2 = 30{,}077$ $t_2 = 12{,}481$
$a_1 = 10{,}931$ $l_3 = 28{,}852$ $t = 3{,}000$
$a_2 = 10{,}782$ $l_4 = 29{,}567$
$a_3 = 10{,}596$ $O_1 = O_2 = 1{,}00$ $O_3 = O_4 = 0{,}870$ $a = 19{,}05$ $l_1 = 28{,}218$ $t_1 = 3{,}000$
$b = 9{,}525$ $l_2 = 29{,}761$ $t_2 = 13{,}426$
$a_1 = 9{,}757$ $l_3 = 28{,}634$ $t_3 = 3{,}000$
$a_2 = 9{,}758$ $l_4 = 29{,}499$ $O_1 = O_2 = 2{,}650$
$a_3 = 9{,}538$ $O_3 = O_4 = 2{,}100$

DUAL-MODE MICROWAVE FILTER

The present invention relates to a dual-mode microwave filter for a waveguide intended, for example, for applications in telecommunications satellites. Such filters are capable of presenting filter transfer functions that are very complex and selective.

BACKGROUND OF THE INVENTION

In the commonest implementation, resonators are used in the form of circular waveguides, together with coupling irises of complex shapes, and each cavity needs to be adjusted manually using a minimum of three adjustment screws.

Dual-mode filters for circular or elliptical waveguides are commonly used in the inlet/outlet networks of communications satellites, and their basic characteristics are well known, e.g. from the article by A. E. Williams "A four-cavity elliptic waveguide filter", published in IEEE Transactions on Microwave Theory & Techniques, Vol. 1.8, (MTT-18), December 1970, pp. 1109–1114, and also in the article by A. E. Atia et al., entitled "Narrow bandpass waveguide filters", published in IEEE Transactions MTT-20, April 1972, pp. 258–265.

In conventional industrial implementations, a dual-mode filter uses crossed irises to provide inter-resonance couplings and generally presents a minimum of three adjustment screws for each cavity, which screws can be adjusted manually. In addition, because of interactions between coupling irises and adjustment screws, it is necessary to devote considerable experimental effort in order to dimension coupling irises properly.

In order to reduce or even eliminate manual tuning by means of tuning screws, and in order to avoid experimental characterization, it is common practice to a use a software tool to perform a complete simulation of the electromagnetic waves in the final filter structure. As a result, various contributions have recently been made in this field, e.g. by proposing the use of square waveguides, for example as described in the article by Xiao-Pen Liang et al., entitled "Dual-mode coupling by square corner cut in resonator and filters", published in IEEE Transactions MTT-40, No. 12, December 2991, pp. 2994–2302, and in the article by R. Ihmels et al., entitled "Field theory of CAD of L-shaped iris coupled mode launchers and dual-mode filters", published in 1993 in IEEE MTT-S Digest, pp. 765–768.

Other articles have proposed other filter geometries, e.g. the article by R. Orta et al., entitled "A new configuration of dual-mode rectangular waveguide filters", published in "Proceedings of the 1995 European Microwave Conference", Bologna, Italy, pp. 538–542, or indeed in the article by S. Moretti et al., entitled "Field theory design of a novel circular waveguide dual-mode filter", published in "Proceedings of the 1995 European Microwave Conference", Bologna, Italy, pp. 779–783; or indeed in the article by L. Accatino et al., entitled "A four-pole dual-mode filter realized in circular cavity without screws", published in 1996 in IEEE MTT-S Digest, pp. 627–629.

In addition, tuning screw modeling has been suggested that makes use of a circular waveguide, for example. That modeling is implemented using finite elements as described in the article by José Montejo-Garai et al., entitled "Full-wave design and realization of multicoupled dual-mode circular waveguide filters", published in IEEE Transactions MTT-43, No. 6, June 1995, pp. 1290–1297.

More recently, a very accurate and efficient software tool has been presented for designing and optimizing the entire structure of a filter, including the influence of tuning screws. This is described in articles by Alvarez et al., entitled "New simple procedure for the computation of the multimode admittance matrix of arbitrary waveguide junction", published in 1995 in IEEE MTT-S Digest, pp. 1415–1418, and by V. Boria et al., entitled "Accurate CAD for dual-mode filters in circular waveguide including tuning elements", published in 1997 in IEEE MTT-S Digest, pp. 1575–1578.

Although all of the studies mentioned above have significantly advanced the state of the art in this field, it nevertheless remains that making outlet multiplexers for satellites that are based on dual-mode filters in the form of circular waveguides still requires a great deal of design time and high cost. This is due essentially to two aspects of the design and manufacturing process. The first is that even if the computer-assisted design (CAD) tools that have been developed are indeed practical for designing simple filters, they are not completely suited to designing complex multiplexers having a large number of channels, e.g. 10 to 20. The second aspect is that the required geometry can have shapes that are very complex, and as a result it is very difficult to make such elements physically with the required precision which is generally better than or equal to 2 micrometers ($\mu$m) to 5 $\mu$m, depending on the electrical specifications.

OBJECTS AND SUMMARY OF THE INVENTION

An object of the present invention is to provide a dual-mode microwave filter which presents the advantages of being simple to design and/or easy to simulate its electromagnetic waves and/or suitable for being manufactured by a method that is simple and low cost.

The invention is based on the idea of using an environment implementing a rectangular waveguide presenting only simple inductive discontinuities.

Given that use is made only of inductive discontinuities in rectangular waveguides, analysis and optimization can be performed in a manner that is much more accurate and efficient than with conventional implementations based on circular waveguides.

Even with complex multichannel multiplexers, design can be performed using known software such as WIND described in the article by M. Guglielmi, entitled "Rigorous network numerical representation of inductive step", published in IEEE Transactions MTT-42, No. 2, February 1994, pp. 317–327, or indeed FEST as described in the article by M. Guglielmi et al., entitled "A CAD tool for complex waveguide components and subsystems", published in Microwave Engineering Europe, March/April 1994, pp. 45–53.

Another advantage is that the required filter structure is very simple and very suitable for high precision manufacture at low cost, thereby reducing the total cost of development and manufacture in highly significant manner.

The invention thus provides a dual-mode microwave filter, comprising a rectangular resonator of length 1, height b, and width a operating in two distinct modes (m, 0, n) and (p, 0, q) from a single family of modes and presenting the same direction as the E field, and wherein coupling and mode excitation discontinuities are inductive and in the same direction. Said length l and width a are advantageously selected to have a ratio such that said two modes resonate at the same frequency, i.e.:

$$F=\left(\frac{m\pi}{a}\right)^2+\left(\frac{n\pi}{l}\right)^2=\left(\frac{p\pi}{a}\right)^2+\left(\frac{q\pi}{l}\right)^2$$

giving:

$$\frac{a}{l}=\sqrt{\frac{m^2-p^2}{q^2-n^2}}$$

with m not equal to p and q not equal to n.

The filter can operate in the $TE_{m,0,n}$ and $TE_{p,0,q}$ modes and it is coupled upstream and downstream to first and second rectangular waveguides via openings which are coupled to both of said modes so as to present a transmission zero at the high end of its pass band.

In another aspect, the filter presents a rectangular resonator as defined above, coupled to a monomode resonator, and the ratio between the width a and the length l of said rectangular resonator is selected so that the filter has a transmission zero in the low portion of its pass band.

A dual-mode four-pole filter may comprise first and second rectangular resonators as defined above, which are coupled to each other, the ratios between the lengths I and the widths a of the two cavities being selected so that the resulting dual-mode four-pole filter presents two transmission zeros.

For example, it presents a transmission zero in the low portion of its pass band and a transmission zero in the high portion cf its pass band.

This filter having two transmission zeros may constitute a narrow bandpass filter.

In particular, m=1, n=2, p=3, and q=1.

In yet another aspect of the invention, the rectangular resonator has at least one corner presenting a square or rectangular notch.

In yet another aspect of the invention, the filter comprises third and fourth coupled-together rectangular resonators, and each rectangular resonator includes adjustment screws through a top or bottom wall.

In particular, m=1, n=2, p=2, and q=1

BRIEF DESCRIPTION OF THE DRAWINGS

Other characteristics and advantages of the invention will appear better on reading the following description given by way of non-limiting example and with reference to the drawings, in which.

MORE DETAILED DESCRIPTION

A resonator forming a dual-mode filter in the form of a circular waveguide uses two degenerate $TE_{1,1,n}$ modes with electric fields that rotate with a phase offset of 90°. By using dual-mode implementation, a single resonator can produce two independent electrical resonances. By connecting two of these resonators in series, it is thus possible to introduce cross-couplings between the four independent resonances so as to obtain complex filter functions.

The adjustment or tuning between the two independent resonances of each resonator is performed by means of an adjustment or tuning screw disposed at 45° relative to the electric fields of the two resonances, with inter-resonator coupling, and with coupling between the inlet and the outlet being performed by coupling irises. The individual resonances are frequency adjusted using additional adjustment screws which extend parallel to the specific dual-mode electric field that is to be adjusted. All of these elements represent discontinuities in the environment of the resonator which excite high order TE and TM modes simultaneously. The presence of these high order modes makes electromagnetic analysis of this type of structure very difficult.

The new family of dual-mode filters proposed by the present invention relies on implementing pairs of modes from the same family of modes in a rectangular resonator.

Figure 1:
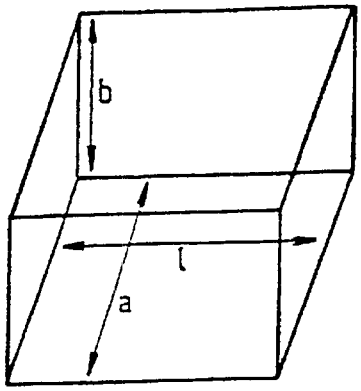
FIG. 1 shows a rectangular filter.

With this concept, many choices are made available starting from the same basic characteristics. To find the mode combinations which are possible in a rectangular resonator of length l, height b, and width a (see FIG. 1), a first condition that is imposed is that the eigenvalue relating to the dimension b is equal to zero, and then the following condition is imposed, whereby both modes are resonant at the same frequency, i.e.:

$$\left(\frac{m\pi}{a}\right)^2+\left(\frac{n\pi}{l}\right)^2=\left(\frac{p\pi}{a}\right)^2+\left(\frac{q\pi}{l}\right)^2$$

In which the eigenvalues m and n relate to the first mode and the eigenvalues p and q relate to the second mode.

The above equation leads to the following expression for the initial choice of ratio a/l for the selected pair of modes:

$$\frac{a}{l}=\sqrt{\frac{m^2-p^2}{q^2-n^2}}$$

The number of waves of the resonance is given by the following formula:

$$K_0=\sqrt{\left(\frac{m\pi}{a}\right)^2+\left(\frac{n\pi}{l}\right)^2}$$

The only additional constraints which must be imposed to obtain dual-mode type operation is that the indices of the modes m & p and n & q must be different, i.e. m must be different from p and n must be different from q. Imposing this last condition serves to ensure that the selected resonance modes are orthogonal at each edge of the resonator, which makes dual-mode operation possible. In addition, when a filter is made with some number of resonators in cascade, different combinations of modes can also be implemented in each resonator so as to improve the response outside the pass band.

It is important to observe that in all of the above equations, the number of waves relating to the dimension b have been selected to be equal to zero. Consequently, choosing a resonant mode from the $TE_{m,0,n}$ family makes it possible to obtain a filter that is very simple and whose structure has discontinuities that are inductive only, which discontinuities are both easy to analyze and easy to manufacture with high mechanical precision.

Another important consequence of this choice is that the Q factor of the structure can be adjusted merely by changing the height b of the resonator in such a manner as to obtain low insertion losses.

Figure 2:
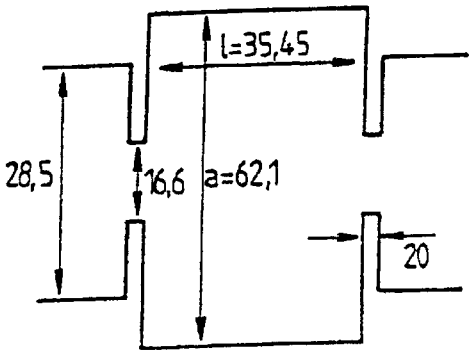
FIGS. 2 and 3 show a first variant of a dual-mode filter, FIG. 3 giving the amplitude profiles as a function of frequency in GHz.
Figure 3:
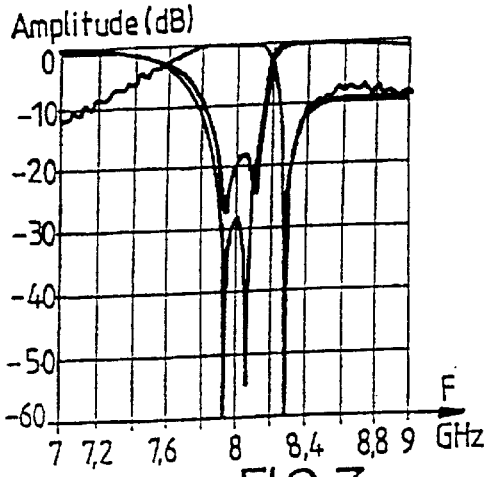

FIG. 2 shows a dual-mode resonator of length l=35.45 mm and width a=62.1 mm which is coupled to a standard rectangular waveguide of width 28.5 mm. In this case the selected modes are $TE_{1,0,2}$ mode and $TE_{3,0,1}$ mode. The simulated and measured responses for this filter are shown in FIG. 3. The filter was simulated using the above-mentioned WIND software. An important characteristic is the presence of a transmission zero on the right of the pass band, i.e. in the high frequency portion thereof. This zero is due to the fact that the inlet and outlet opening of width 16.6 mm couples both the $TE_{1,0,2}$ and $TE_{3,0,1}$ modes. Given that the resonance of $TE_{1,0,2}$ mode changes sign when the field moves from the inlet to the outlet, destructive interference is produced which produces the above-mentioned transmission zero.

Figure 4:
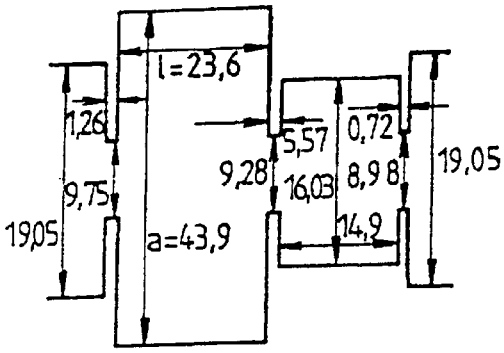
FIG. 4 shows a three-pole dual-mode filter presenting two coupled-together rectangular filters, the first filter being a dual-mode filter and the other a monomode resonator, with FIG. 5 representing the insertion and return loss curves in decibels as a function of frequency in GHz.
Figure 5:
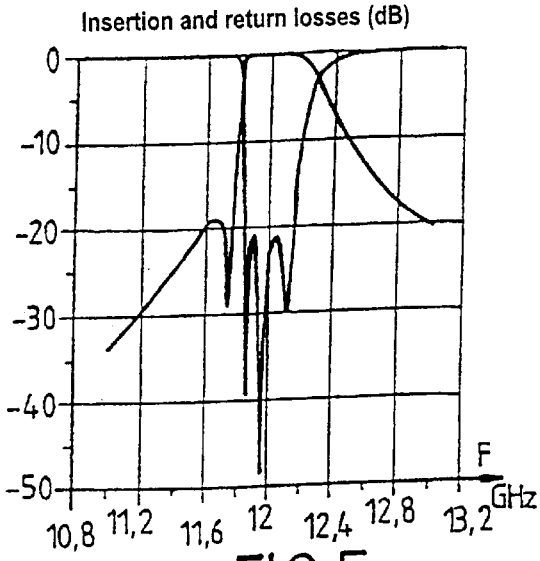

Another example is given in FIG. 4. In this filter, the first resonator is a dual-mode resonator using the same pair of modes as in FIG. 2. The second resonator is a standard, single-mode resonator. For this filter, the ratio a/l between the width and the length of the dual-mode resonator is selected in such a manner that the destructive interference gives rise to a transmission zero on the left, i.e. in the low frequency portion of the pass band of the filter. The simulated response for this filter as calculated using the WIND software is given in FIG. 5.

Figure 6:
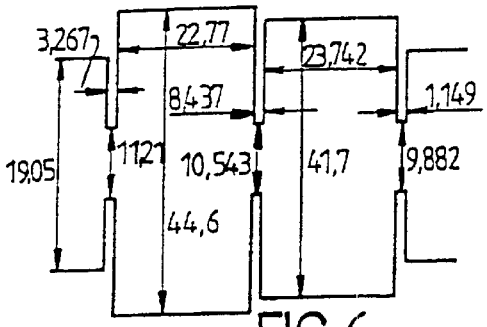
FIG. 6 shows a four-pole filter having two coupled-together cavities and its insertion and return loss curves in decibels as a function of frequency in GHz are given in FIG. 7.
Figure 7:
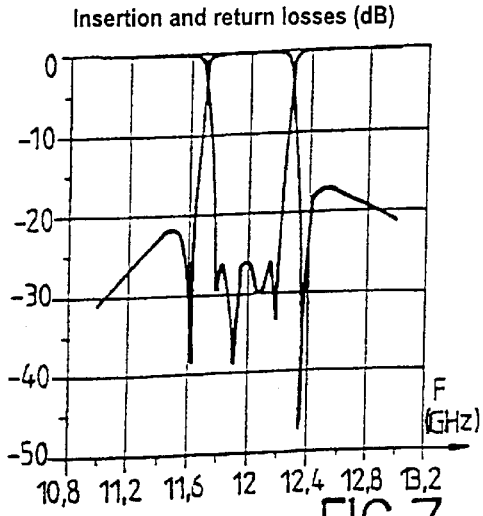

The filter shown in FIG. 6 implements two coupled-together dual-mode cavities, each of them using both the $TE_{1,0,2}$ and the $TE_{3,0,1}$ modes to obtain transmission zeros situated both on the left and on the right of the pass band. The simulated response for this filter which was designed using the WIND software is given in FIG. 7.

Figure 8:
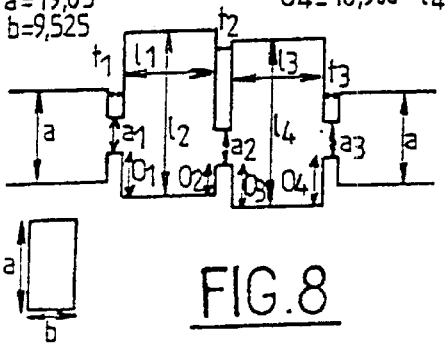
FIGS. 8, 10, 12, and 14 show other variants of the invention and the corresponding insertion and return loss curves as a function of frequency in GHz are given respectively in FIGS. 9, 11, 13, and 15.
Figure 9:
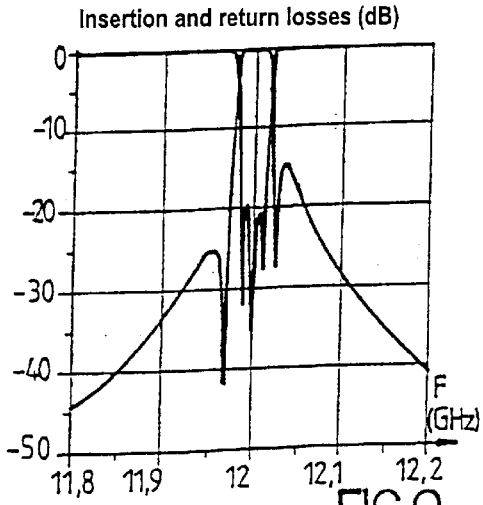

Another example of a four-pole filter with two transmission zeros that have been optimized to obtain a narrow band response of the type required in outlet multiplexers is shown in FIG. 8. The modes used are likewise the $TE_{1,0,2}$ and the $TE_{3,0,1}$ modes. The simulated response for this filter designed using the WIND software is given in FIG. 9.

Figure 10:
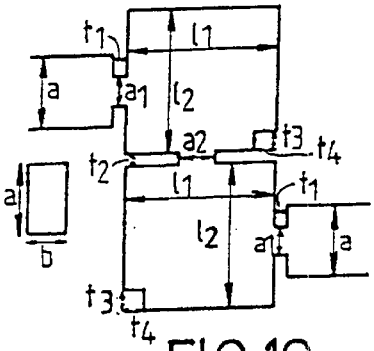
Figure 11:
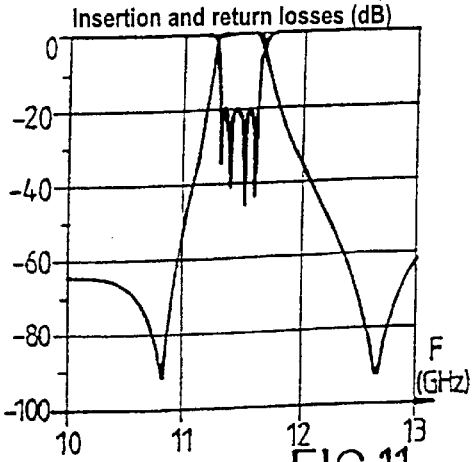

Another example of a filter is shown in FIG. 10 and this filter uses the $TE_{1,0,2}$ and the $TE_{2,0,1}$ modes. The structure of this filter was simulated using the FEST software and the results are given in FIG. 11. Coupling between the orthogonal modes was introduced by using discontinuities of dimensions $T_3$ and $T_4$ placed in the corners of the dual-mode resonators. In addition, inlet and outlet couplings are no longer disposed in continuity, but are disposed on the contrary at 90°.

Figure 12:
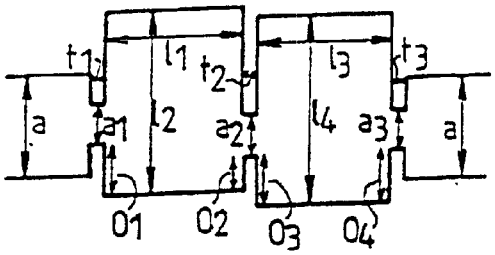
Figure 12:
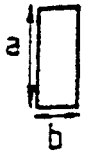
Figure 13:
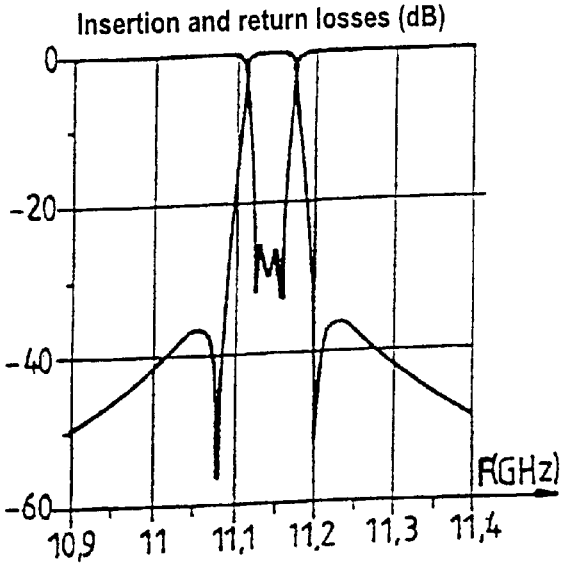

The $TE_{1,0,2}$ and $TE_{2,0,1}$ modes can also be used in an in-line configuration. The dimensions of a Ku band filter using this configuration are given in FIG. 12, and the simulated response curves in FIG. 13.

Figure 14:
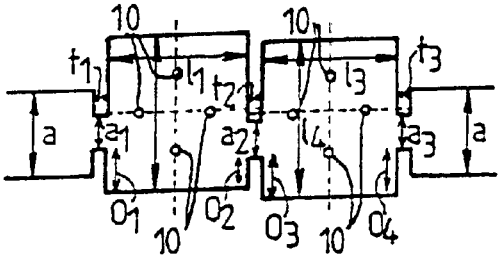
Figure 14:
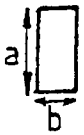
Figure 15:
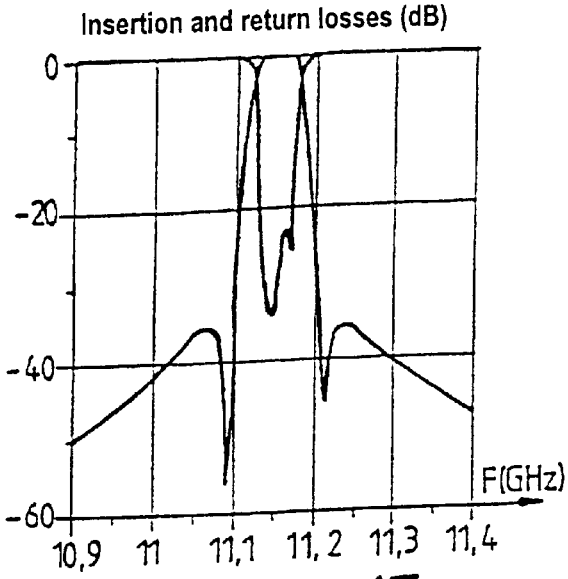

The filter shown in FIGS. 14 and 15 can be adjusted manually. This characteristic is essential for narrow band applications where the mechanical precision required to implement non-tunable filters is not achievable with present-day techniques. FIG. 14 shows the structure of a narrow band Ku band filter in which adjustment screws 10 are used. The simulated results of these filters including the adjustment screws (penetration by 1 mm) were performed using the DUMAS software and they are shown in FIG. 15.

The additional characteristic of the in-line structure of FIG. 14 is that it also lends itself to a dielectric or metallic load. This is due to the particular configuration of the filter inside the resonator. The two series of dashed lines at 90° to each other in FIG. 14 show regions in which the value of the electric field is equal to zero. These lines cross in the center of each resonator, showing that both resonance modes correspond to an electric field of zero value at this location. Advantage can be taken of this characteristic in two ways. The first is that it is possible to insert a dielectric rod in the center of the cavity to decrease the total volume of the resonator which is necessary at a given frequency. The second is that it is possible to insert a metal rod at the same location. By using a material having a suitable coefficient of thermal expansion, it is then possible to compensate for variation in the center frequency of the filter as a function of temperature. This characteristic is particularly advantageous for satellite applications since they make it possible to use lightweight materials to manufacture the filter while still obtaining high temperature stability.

As shown in the description of the above example, dual-mode filters using the $TE_{m,0,n}$ family of modes in a rectangular resonator are very simple to simulate and to optimize because they make use of inductive discontinuities only. Another advantage is that they can be made using high precision manufacturing techniques of low cost and they are ideally suited to applications to multiplexers on board satellites.

What is claimed is:

1. A dual-mode microwave filter, comprising a rectangular resonator of length l, height b, and width a operating in two distinct modes (m, o, n) and (p, o, q) from a single family of modes said modes being $TE_{m,o,n}$ and $TE_{p,o,q}$ modes presenting the same direction as the E field, and wherein coupling and mode excitation discontinuities are inductive and in the same direction.

2. A filter according to claim 1, wherein said length l and width a are selected to have a ratio such that said two modes resonate at the same frequency:

$$F = \left(\frac{m\pi}{a}\right)^2 + \left(\frac{n\pi}{l}\right)^2 = \left(\frac{p\pi}{a}\right)^2 + \left(\frac{q\pi}{l}\right)^2$$

giving:

$$\frac{a}{l} = \sqrt{\frac{m^2 - p^2}{q^2 - n^2}}$$

with m not equal top and q not equal to n.

3. A filter according to claim 1, coupled upstream and downstream to first and second rectangular waveguides via openings which are coupled to both of said modes so as to present a transmission zero at the high end of its pass band.

4. A filter according to claim 2, wherein the rectangular resonator of length l, height b and width a is coupled to a monomode resonator, and wherein the ratio between the width a and the length l of said rectangular resonator is selected so that the filter has a transmission zero in the low portion of its pass band.

5. A filter according to claim 2, further comprising a second rectangular resonator of length l', height b' and width a' wherein said length l', and width a' are selected to have a ratio such that said two modes resonate at the same frequency $$F = \left(\frac{m\pi}{a}\right)^2 + \left(\frac{n\pi}{l}\right)^2 = \left(\frac{p\pi}{a}\right)^2 + \left(\frac{q\pi}{l}\right)^2$$

-continued giving:

$$\frac{a}{l} = \sqrt{\frac{m^2 - p^2}{q^2 - n^2}}$$

with m not equal top and q not equal to n, said resonator of length l and width a and said second resonator are coupled to each other, the ratios between the length l and the width a and length l' and width a' of the respective first and second resonators being selected so that the resulting dual-mode four-pole filter presents first and second transmission zeros.

6. A filter according to claim 5, presenting the first transmission zero in the low portion of its pass band and the second a transmission zero in the high portion of its pass band.

7. A filter according to claim 5, constituting a narrow bandpass filter.

8. A filter according to claim 1, wherein m=1, n=2, p=3, and q=1.

9. A filter according to claim 1, wherein the rectangular resonator has at least one corner presenting a square or rectangular notch.

10. A filter according claim to 1, further comprising a second rectangular resonators coupled to said rectangular resonator of length l, height b and width a, and wherein each rectangular resonator includes adjustment screws through a top or bottom wall.

11. A filter according to claim 10, wherein m=1, n=2, p=2, and q=1.

12. The filter of claim 5, wherein a=a' and l=l'.

* * * * *